US006240694B1

(12) United States Patent
Castaño

(10) Patent No.: US 6,240,694 B1
(45) Date of Patent: Jun. 5, 2001

(54) STORAGE DOME FOR COMBUSTIBLE BULK MATERIAL

(75) Inventor: Francisco Castaño, Houston, TX (US)

(73) Assignee: Geometrica, Inc., Houston, TX (US)

( * ) Notice: Subject to any disclaimer, the term of this patent is extended or adjusted under 35 U.S.C. 154(b) by 0 days.

(21) Appl. No.: 09/461,465

(22) Filed: Dec. 14, 1999

(51) Int. Cl.[7] ..... E04H 5/02

(52) U.S. Cl. ..... 52/653.1; 52/653.2; 52/654.1; 52/81.1; 52/81.2; 52/80.2

(58) Field of Search ..... 52/653.1, 653.2, 52/654.1, 674, 676, 741.3, 745.06, 745.07, 80.2, 81.2, 81.1

(56) References Cited

U.S. PATENT DOCUMENTS

| | | | | |
|---|---|---|---|---|
| 2,914,074 | * | 11/1959 | Fuller | 52/653.1 |
| 2,964,147 | * | 12/1960 | Pentiman | 52/653.1 |
| 2,976,968 | * | 3/1961 | Pentiman | 52/653.1 |
| 3,079,681 | * | 3/1963 | Pentiman | 52/653.1 |
| 3,468,082 | * | 9/1969 | Hadley | 52/653.2 |
| 3,690,078 | * | 9/1972 | Maynard, Jr. | 52/86 |
| 3,921,555 | * | 11/1975 | Suzuki et al. | 113/116 |
| 4,262,461 | * | 4/1981 | Johnson et al. | 52/81 |
| 4,400,927 | * | 8/1983 | Tinase | 52/745 |
| 4,567,707 | * | 2/1986 | Herman | 52/586 |
| 4,603,519 | * | 8/1986 | Lew et al. | 52/81 |
| 4,750,807 | * | 6/1988 | Felix | 350/125 |
| 4,970,841 | * | 11/1990 | Zeigler | 52/646 |
| 5,305,571 | * | 4/1994 | Trevino | 52/653.2 |
| 5,867,961 | | 2/1999 | Castano . | |
| 5,924,258 | | 7/1999 | Castano . | |
| 6,085,468 | * | 7/2000 | Quiring et al. | 52/63 |

* cited by examiner

*Primary Examiner*—Beth A. Stephan
*Assistant Examiner*—Phi Dieu Tran. A
(74) *Attorney, Agent, or Firm*—Haynes and Boone, L.L.P.

(57) ABSTRACT

A structure includes a framework including frame members interconnected by hub members. The framework includes an inner surface and an outer surface. Cladding material is attached to the inner surface of the framework to form an enclosure or shell within the framework and maintain the framework exterior of the cladding material. This arrangement limits the collection of dust on the structural space frame elements due to the absence of the framework from the interior of the structure.

20 Claims, 5 Drawing Sheets

STORAGE DOME FOR COMBUSTIBLE BULK MATERIAL

BACKGROUND

The disclosures herein relate generally to space frames and more particularly to internal cladding mounted on a space frame structure.

There are recent improvements in space frame structures. In U.S. Pat. No. 5,867,961, a cladding support system for a framework includes rounded tubular members having an arcuate face and flattened opposite ends inserted into cylindrical hubs. A support element includes an elongated span and opposite end portions each including a terminal end. The span has an arcuate surface in seated engagement with the arcuate face of the tubular member. The end portions of the support element each have a tapered surface coextensive with and angularly disposed relative to the arcuate surface. The tapered surface includes a groove at each terminal end of the support element for receiving the flattened ends of the tubular members. The terminal ends are angular and overhang the cylindrical hubs.

In U.S. Pat. No. 5,924,258, a cladding support system includes rounded tubular members having an arcuate face. The tubular members are connected to extend outwardly from hubs. A cladding support member is mounted on the arcuate face of the tubular members and extends transversely across the tubular members. The support member is substantially "U" shaped including a raised closed end and a pair of sides terminating at an open end. A flange extends outwardly from each side. Each flange is attached to the arcuate face of the tubular member. Cladding is attached to the raised closed end of the support member.

In recent years, as society becomes more and more environmentally conscious, there is an increased need for covering very large piles of dry bulk aggregate materials, such as limestone, coal, mineral ores, fertilizer, and grains. Covering these piles prevents air and runoff pollution and protects the materials from contamination.

One of the preferred solutions that has emerged to satisfy this need is the metallic dome. The dome's framework is constructed of interconnected steel or aluminum sections, and the cladding generally consists of corrugated or flat sheets of the same metal laid and fastened over the structure. Metallic domes have the obvious advantages of lighter weight and lower costs. However, their use presents some special problems when the stored bulk material is combustible. Coal, fertilizer and grains fall into this category.

These problems include the fact that combustible materials may expose the structure to heat if they catch fire or combust spontaneously. The heat may easily exceed the safe levels at which aluminum or even steel maintain their strength. Dust may accumulate on the members of the structure. This dust may be dislodged from the structure elements easily by any of a number of events, such as strong winds, machinery vibrations, earthquake, vehicle impact, etc. The dust from such combustible materials may present a well known potentially hazardous situation. Lastly, in the case of corrosive material storage, the accumulation of corrosive dust on the structural space frame elements will eventually corrosively damage the structural elements.

Therefore, what is needed is an apparatus and a method of constructing a space frame dome structure that protects the structural elements from heat, and at the same time limits the collection of dust on the structural space frame elements.

SUMMARY

One embodiment, accordingly, provides an apparatus and a method for cladding a space frame dome structure internally for protecting the frame from heat and limiting the accumulation of combustible dust on the structural frame members. To this end, a structure includes a framework having frame members interconnected by hub members. The framework has an inner surface and an outer surface. Cladding material is attached to the inner surface of the framework to form an enclosure with the framework and maintain the framework exterior of the cladding material.

A principal advantage of this embodiment is that the structural frame elements are protected from heat within the structure. Also, dust from bulk material being stored in the structure is unable to settle and accumulate on the structural frame elements. Another advantage is that the structure has an exterior rough surface that diffuses wind forces acting thereon. Therefore in locations where wind design is a critical factor, such as in costal regions, the normally required weight of the structure may be reduced.

DETAILED DESCRIPTION

Figure 1:
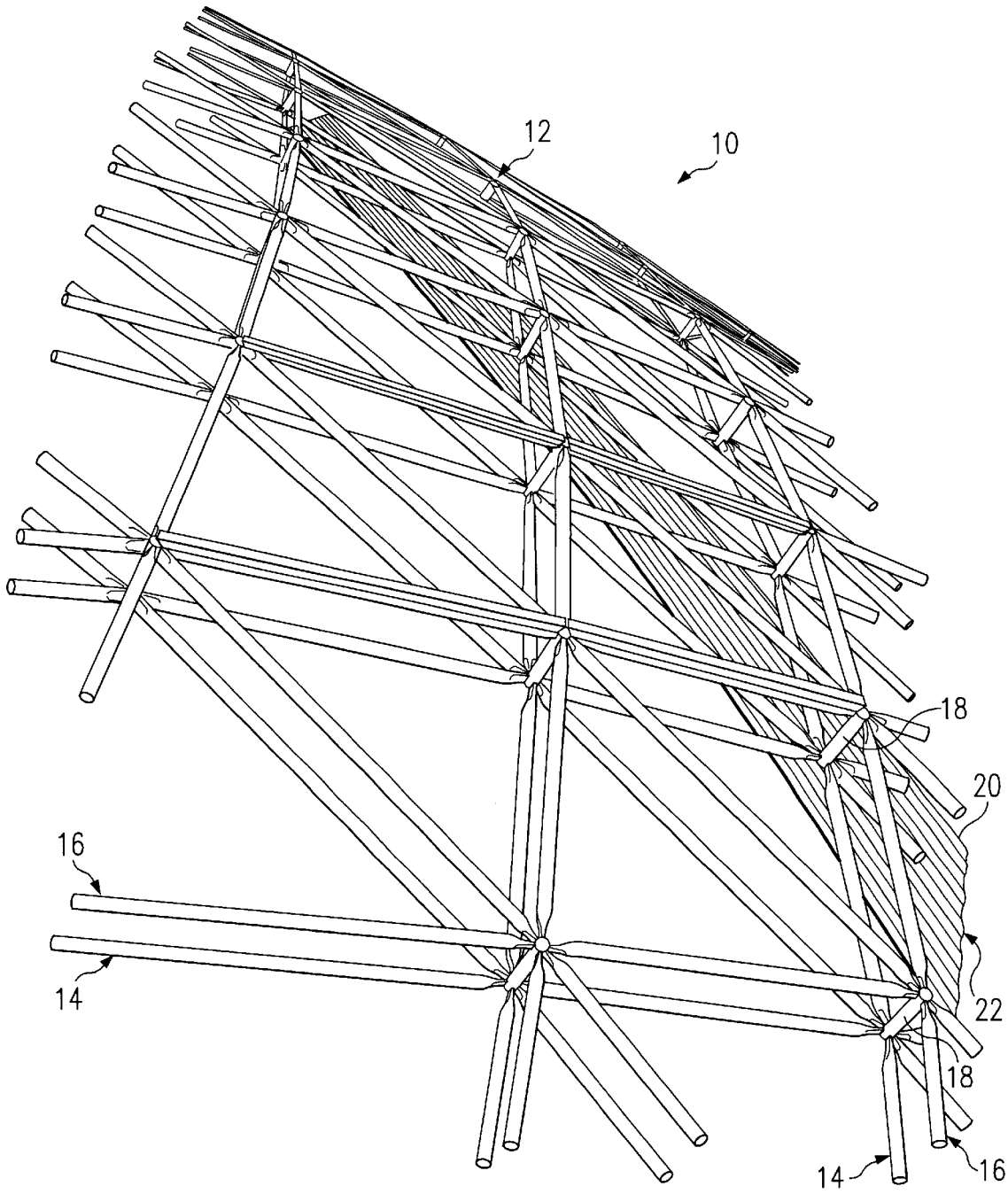
FIG. 1 is a perspective view illustrating an embodiment of a space-frame building structure.

A space-frame building structure is generally designated 10 in FIG. 1, and includes a main framework 12 which comprises an inner surface portion 14, an outer surface portion 16, and may include a plurality of spacer members 18 interconnecting the inner and outer portions 14, 16, in a spaced apart, stacked structural arrangement. A cladding material 20 is attached to the inner surface 14 resulting in the cladding material 20 forming an interior shell 22 of structure 10, and the framework 12 being exterior to the cladding material 20. A single surface 14 may be used, however stacked surfaces 14 and 16 are preferred. In the event that a single surface 14 is used, the cladding material 20 is mounted on the interior side thus positioning the surface 14 exterior to the cladding material 20.

Figure 2:
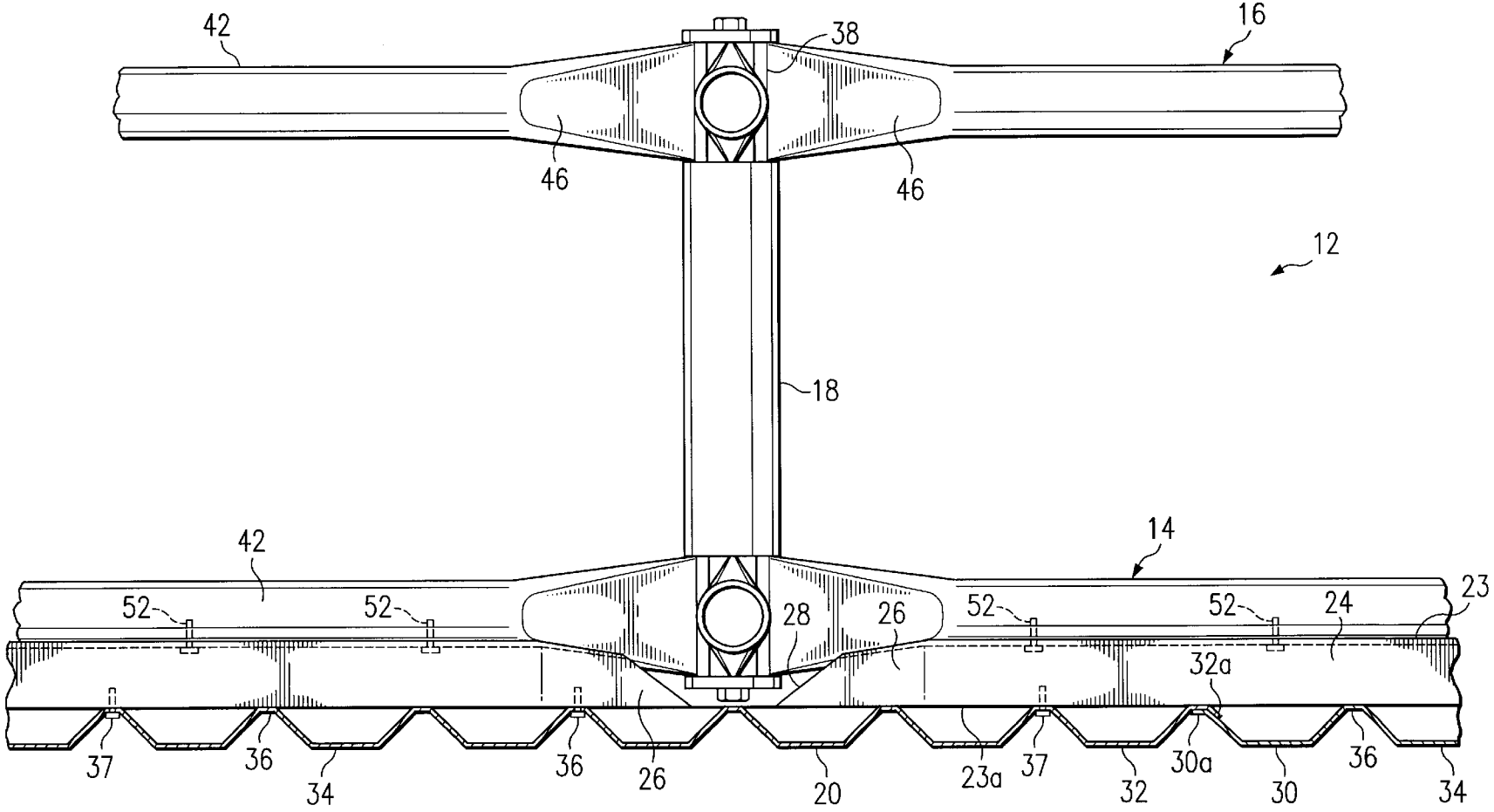
FIG. 2 is a partial cross-sectional view illustrating an embodiment of a main frame including inner and outer, spaced apart frameworks and an attached cladding layer.

More particularly, FIG. 2 illustrates the framework 12 including the inner surface 14, the outer surface 16, one of the spacer members 18, and the cladding material 20. Framework 12 also includes a rectangular tube shaped cladding support element 23 having an elongated span 24 and opposite end portions 26 having a tapered surface 28. Support element 23 includes a flat surface 23*a* for supporting the attachment of cladding material 20.

The cladding material 20 comprises rectangular sheets 30 and 32. Each sheet 30 and 32 has a corrugated profile including ridges 34 and valleys 36. Sheet 30 has an edge portion 30*a* and sheet 32 has an edge portion 32*a*. The edge portions 30*a* and 32*a* overlap and the sheets 30 and 32 are attached to the flat surface 23*a* by self-tapping screws 37.

Figure 3:
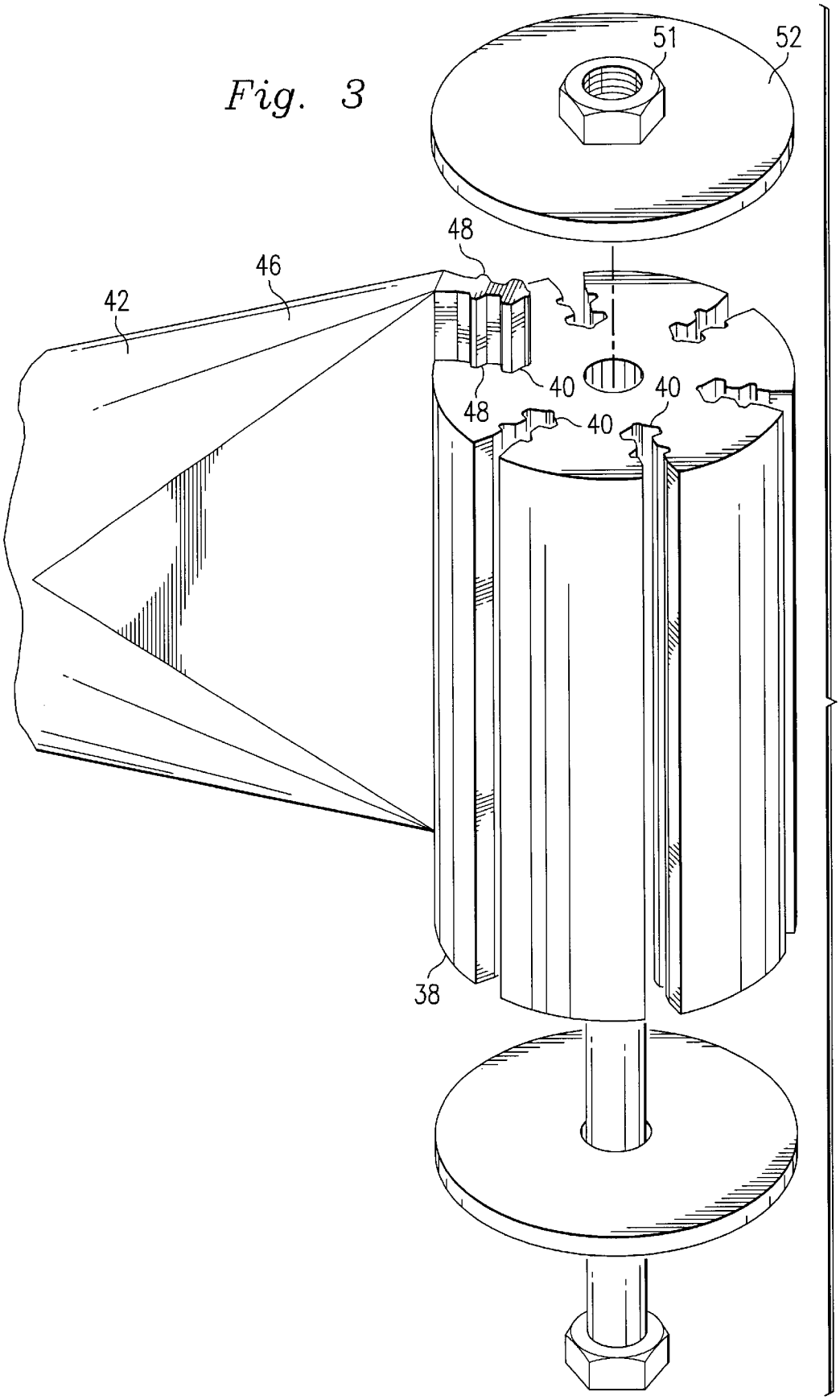
FIG. 3 is a partial cross-sectional perspective view illustrating an embodiment of a hub having a frame member attached thereto.
Figure 4:
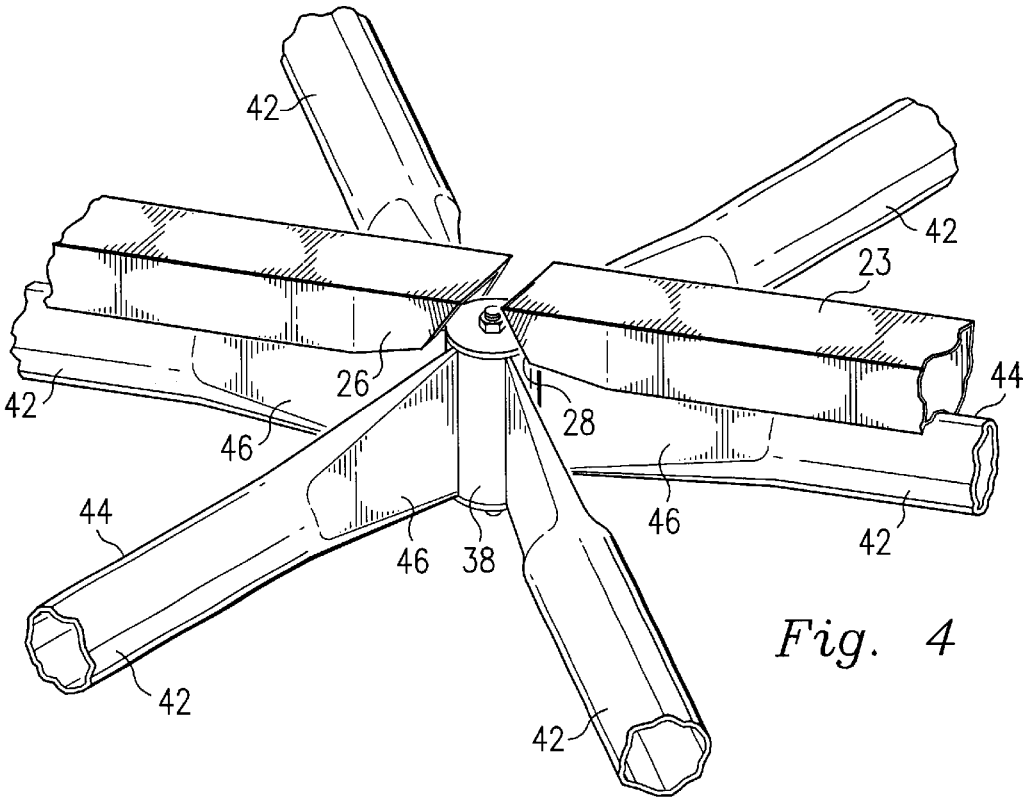
FIG. 4 is a partial perspective view illustrating an embodiment of a hub having frame members and support elements attached thereto.
Figure 5:
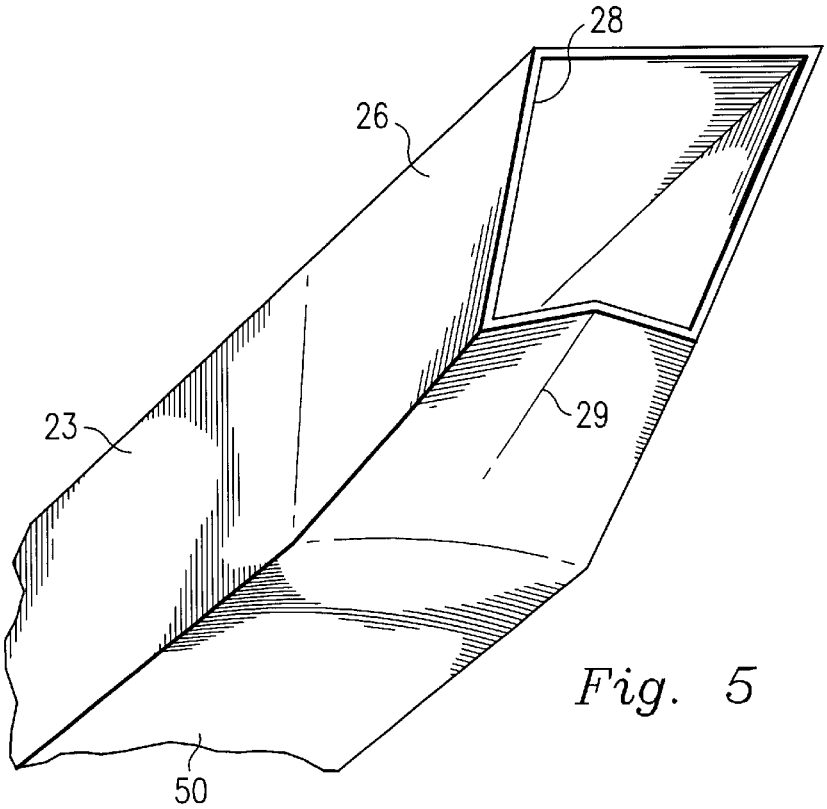
FIG. 5 is a partial perspective view illustrating an embodiment of a support element.

Each surface 14 and 16, FIGS. 2 and 3, includes a hub 38 having plurality of ribbed slots 40 formed therein, and a plurality of tubular structural members 42 attached to each hub 38. Members 42 include flattened opposite ends 46 having ribs 48 for insertion into the ribbed slots 40. An arcuate face 44, FIGS. 4 and 5, of the tubular members 42 receives an arcuate face 50, of support element 23 and end portion 26 of support elements 23 include the tapered surface 28 for covering hub 38, and a groove 29 for receiving the flattened ends 46 of the tubular structural members 42. In this manner, support elements 23 are provided for nested engagement with tubular members 42. Attachment of support elements 23 to respective tubular members 42 is accomplished by the use of suitable fasteners such as self-tapping screws 52, FIG. 2.

Referring again to FIGS. 1 and 2, the inner surface 14 of main framework 12, and the outer surface 16 are maintained in spaced apart relationship by spacer members 18. The cladding material 20, which is attached to the inner surface 14, forms an interior shell 22 and maintains the entire framework 12 on the exterior of the building 10. Although framework 12 is described above as including tubular structural member 42 attached to hubs 38, it is recognized that structural members having various cross-sections, e.g. I, rectangular, angular, etc., may be used to form the exterior main framework 12 having an interior shell 22 of cladding material 20 attached thereto.

Figure 6:
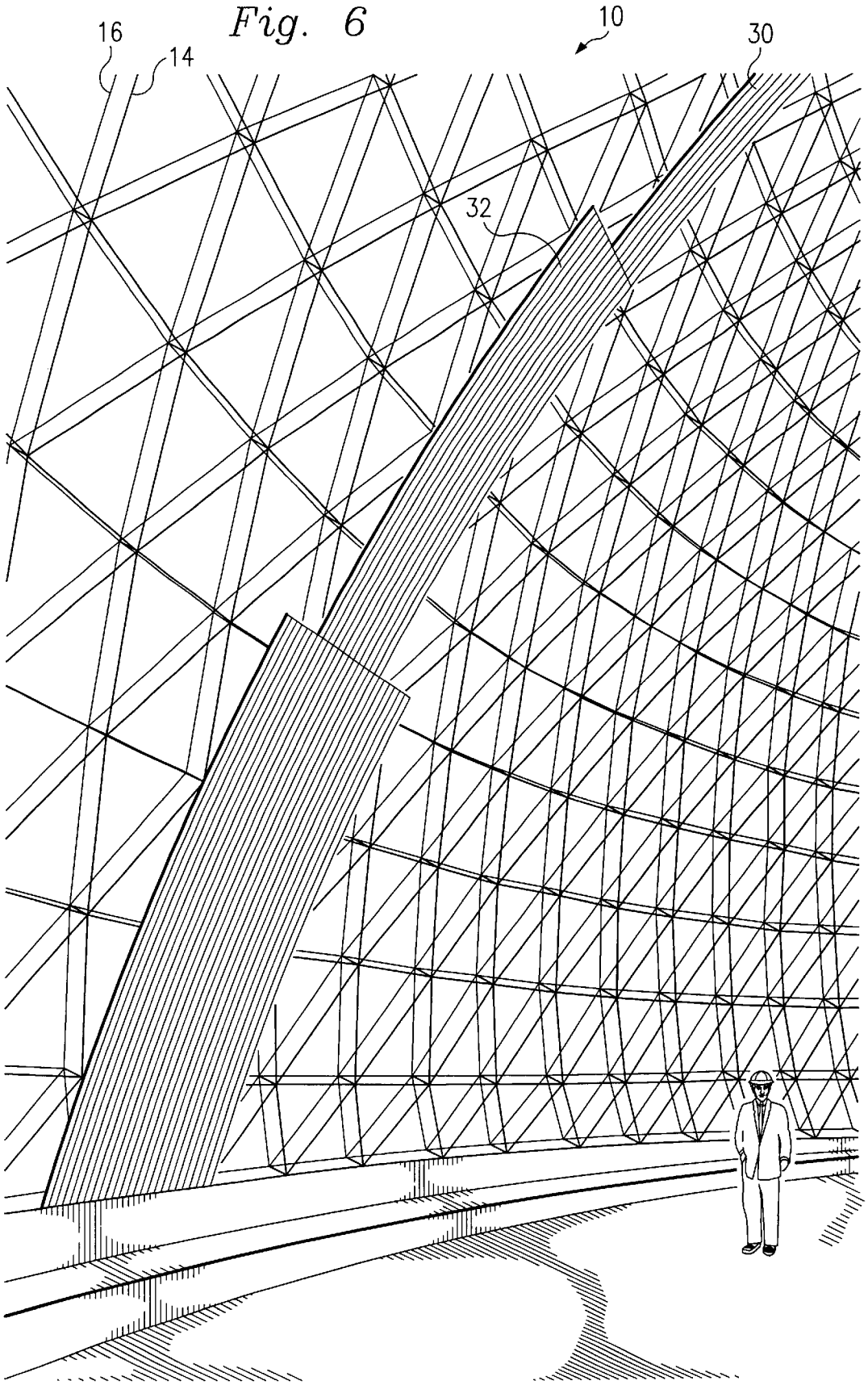
FIG. 6 is a perspective view illustrating an embodiment of a space frame building structure.

In FIG. 6, the rectangular sheets 30 and 32 of cladding material are illustrated as mounted on the inner surface 14, and the outer surface 16 is spaced apart from the inner surface 14 to form the stacked main framework 12. The sheets 30 and 32 of cladding material 20, when fully installed, form the continuous interior shell 22 of the building 10, and the stacked structural framework is exterior to the cladding.

Again in FIG. 2, the inner surface 14 is formed including tubular structural members 42 interconnected by hub members 38. The outer surface 16 is similarly formed by tubular structural members 42 interconnected by hub members 38. The inner and outer surfaces, 14 and 16, respectively, are connected in a stacked, spaced apart relationship, positioning the inner surface portion 14 within the outer surface portion 16. By connecting the inner surface 14 to the outer surface 16 in a stacked, spaced apart relationship by means of spacer members 18, and attaching sheets 30 and 32 of cladding material to the support elements 23 on the inner surface 14, the interior shell 22 is formed, and the framework 12 is exterior of the cladding material. As a result, one embodiment provides a structure including a framework having frame members interconnected by hub members. The framework has an inner surface and an outer surface. A cladding material is attached to the inner surface of the framework to form an enclosure within the framework and maintain the framework exterior of the cladding material.

Another embodiment provides a space-frame building structure including a framework having an inner side and an outer side. A plurality of sheets of overlapping cladding material are attached to the inner side of the framework to form a continuous interior surface within the framework. In this manner, the framework is exterior to the cladding material.

A further embodiment provides a method of cladding a structure internally of an external frame. The frame includes a framework including frame members interconnected by hub members. The framework includes an inner side and an outer side. Sheets of cladding material are attached to the inner side of the framework to form an interior surface of the structure. In this manner, the framework is exterior to the structure and the cladding material is interior to the structure.

As it can be seen, the principal advantages of these embodiments are that the structural frame elements are protected from heat within the structure. Dust from bulk material being stored in the structure is unable to accumulate on the structural frame elements. The structure is internally clad by attachment of rectangular corrugated sheets to the frame elements using self-tapping screws. The corrugated sheets provide valleys which function as a rain or moisture drain. The rectangular sheets may be arranged to permit the efficient and effective cladding of the doubly curved structural surface.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A structure comprising:

a framework including frame members interconnected by hub members, the framework having an inner surface and an outer surface; and a cladding material attached to the inner surface of the framework to form an enclosure within the framework and maintain the framework exterior of the cladding material;

wherein the frame members include rounded tubular members having an arcuate face and flattened opposite ends, the ends having ribs inserted into ribbed slots formed in the hub members;

a cladding support element having an elongated span and opposite end portions, the span having an arcuate surface in seated engagement with the arcuate face of the tubular members, the end portions each having a tapered surface including a groove receiving the flattened ends of the tubular members.

2. The structure as defined in claim 1 wherein the support element is a rectangular tube having a flat surface.

3. The structure as defined in claim 1 wherein the cladding material is attached to the flat surface.

4. The structure as defined in claim 3 wherein the cladding material has a corrugated profile including ridges and valleys.

5. The structure as defined in claim 4 wherein the cladding material is attached to the inner surface by self-tapping screws.

6. The structure as defined in claim 5 wherein the cladding material includes rectangular sheets having edge portions overlapping adjacent rectangular sheets of cladding material.

7. The structure as defined in claim 3 wherein the cladding material is attached to the flat surface by self-tapping screws.

8. The structure as defined in claim 7 wherein the cladding material includes rectangular sheets having edge portions overlapping adjacent rectangular sheets of cladding material.

9. A space-frame building structure comprising:

a framework having an inner side and an outer side; and a plurality of sheets of overlapping cladding material attached to the inner side of the framework to form a continuous interior surface within the framework, whereby the framework is exterior to the cladding material;

wherein the inner side of the framework includes rounded tubular members connected to hub members, the tubular members having an arcuate face and flattened opposite ends, the ends having ribs inserted into ribbed slots formed in the hub members;

a cladding support element having an elongated span and opposite end portions, the span having an arcuate surface in seated engagement with the arcuate face of the tubular members, the end portions each having a tapered surface including a groove receiving the flattened ends of the tubular members.

10. The structure as defined in claim 9 wherein the support element is a rectangular tube having a flat surface.

11. The structure as defined in claim 10 wherein the cladding material is attached to the flat surface.

12. The structure as defined in claim 9 wherein the cladding material has a corrugated profile including ridges and valleys.

13. The structure as defined in claim 12 wherein the cladding material is attached to the inner side by self-tapping screws.

14. The structure as defined in claim 13 wherein the cladding material includes rectangular sheets having edge portions overlapping adjacent rectangular sheets of cladding material.

15. The structure as defined in claim 11 wherein the cladding material is attached to the flat surface by self-tapping screws.

16. The structure as defined in claim 15 wherein the cladding material includes rectangular sheets having edge portions overlapping adjacent rectangular sheets of cladding material.

17. A method of cladding a structure internally of an external frame comprising the steps of:

forming a framework including rounded tubular frame members interconnected by hub members, the framework having an inner side and an outer side; and attaching sheets of a cladding material to the inner side of the framework to form an interior surface of the structure, whereby the framework is exterior to the structure and the cladding material is interior to the structure;

providing the rounded tubular members with an arcuate face and flattened opposite ends, the ends having ribs inserted into ribbed slots formed in the hub members;

providing a cladding support element having an elongated span and opposite end portions, the span having an arcuate surface in seated engagement with the arcuate face of the tubular members, the end portions each having a tapered surface including a groove receiving the flattened ends of the tubular members.

18. The method as defined in claim 17 wherein the step of attaching sheets includes the step of attaching the sheets by self-tapping screws.

19. The method as defined in claim 17 further comprising the step of attaching a plurality of cladding support elements to the inner side.

20. The method as defined in claim 19 wherein the step of attaching sheets of cladding material includes the step of attaching the cladding material to the cladding support elements.

* * * * *